US005388307A

United States Patent [19]

Hyde

[11] Patent Number: 5,388,307

[45] Date of Patent: Feb. 14, 1995

[54] SHAFT RETAINING COLLAR

[75] Inventor: James P. Hyde, Cary, N.C.

[73] Assignee: Custom Molders, Inc., Durham, N.C.

[21] Appl. No.: 52,571

[22] Filed: Mar. 11, 1993

[51] Int. Cl.[6] ..... B25G 1/00

[52] U.S. Cl. ..... 16/121

[58] Field of Search ..... 16/121; 292/352

[56] References Cited

U.S. PATENT DOCUMENTS 2,046,342 7/1936 Muck et al. ..... 292/352

FOREIGN PATENT DOCUMENTS 12140 of 1902 United Kingdom ..... 292/352

*Primary Examiner*—P. Austin Bradley
*Assistant Examiner*—Chuck Y. Mah
*Attorney, Agent, or Firm*—Olive & Olive

[57] ABSTRACT

The present invention comprises a shaft retaining collar and a knob adapted to receive and utilize the collar. The collar is integrally formed with a base portion having a protruding button extending outwardly in one direction and a pair of opposed spring fingers positioned opposite to the button. The collar is adapted to be assembled into a knob or other component to be mounted on a shaft and having an internal cavity sized to accept the collar. An internal, keyhole shaped aperture is formed in the central area of the collar. When so assembled within the knob, the collar may be moved from a first position in which a smaller diameter portion of the aperture straddles a groove formed in the shaft to secure the shaft against relative axial movement and a second position in which a larger diameter portion of the aperture is positioned to allow the shaft to be inserted or retracted.

4 Claims, 2 Drawing Sheets

SHAFT RETAINING COLLAR

BACKGROUND OF THE INVENTION

1. Field of the Invention

This invention relates to apparatus for mechanically grasping a shaft so as to prevent axial movement of the shaft with relation to the grasping apparatus, and more particularly, to means to releasably attach a knob or the like to the end of a shaft.

2. Description of the Related Art

There are numerous applications in which a knob or other device is mounted on the end of a shaft so that the device and the shaft are essentially locked together. In some instances, it is also required that the device not be able to rotate on the shaft on which the device is mounted. One such application occurs in a commonly known automotive headlight switch. The familiar operation of such a switch involves pulling the knob rearward in the vehicle and actuating the parking lights and the headlights. In addition, by rotating the knob, the vehicle's instrument lights are adjusted and the interior light is operated. Typically, the shaft rotates in synchronization with the knob to accomplish the operations.

In regard to the described type of headlight switch in a vehicle, there is occasionally a need to remove the knob from the shaft in order to remove the dashboard facia for service reasons. This need requires the knob attachment means to be removable without damage so as to be replaceable.

An existing knob anchoring means for a headlight switch comprises a formed sheet metal clip which is positioned within the knob. The clip is configured to accept the shaft and has a resilient flap which is bent by the insertion of the shaft so as to firmly grasp the shaft end. The rotational aspect of the prior art clip is accomplished by means of a non-round shaft and a mating non-round bore in the knob or in the clip (see FIGS. 1, 2A, 2B).

The existing clip described above holds the knob, but the knob is not removable when in use except by use of a special tool or by reaching beneath the dashboard to release the end of the shaft which is anchored into the switch body. An attempt to remove the knob without the special tool results in damaging and making the clip inoperable.

Another known device (FIG. 1) is used to anchor one end of a shaft used in a light switch when the opposite end of the shaft mounts to a knob used to actuate the switch functions. This anchoring device comprises an "L" shaped clip mounted on the end of a button having a captive compression spring. The shaft passes through a keyhole-shaped aperture formed in the "L" shaped clip. By pressing the button and compressing the spring, the "L" shaped clip and its aperture are moved from a position in which the "L" shaped clip lockingly engages the end of the shaft to a position in which the shaft is free to be removed. While the described device permits rotation of the shaft in the "L" shaped clip and prevents relative axial movement between the device and the shaft, both of which are advantages, the drawback to this type of shaft anchoring device is that it requires several manufacturing and assembly steps to produce and install, thus making it relatively expensive.

It is therefore an object of this invention to provide a device which can be used to assemble a knob to a shaft and prevent relative axial movement therebetween but which can be easily released to remove the knob from the shaft when necessary.

It is a further object of this invention to provide a device which can be used to assemble a knob to a shaft and prevent relative axial movement therebetween and which is both inexpensive to manufacture and to install.

Other objects and advantages will be more fully apparent from the following disclosure and appended claims.

SUMMARY OF THE INVENTION

The present invention provides a shaft retaining collar formed of a single piece of plastic and combining the features of a resilient biasing member and a shaft retaining member and providing an assembly which is easy to install and easy to remove. The collar of the invention is formed to fit within a cavity in an automotive light switch knob with adequate space to be moved linearly in a direction perpendicular to the axis of the mounting shaft. The collar comprises an integral button at one end and integral spring fingers at the other end thereof. The collar is formed with an aperture a portion of which is of a large diameter and a portion of which is of a small diameter.

When installed in the light switch knob, the collar is normally in a position so that the small diameter portion of the aperture is axially aligned with the bore axis of the knob. When pressure is applied to the integral button, the collar is moved against the biasing force of the integral spring fingers so that the large diameter portion of the aperture is axially aligned with the bore axis of the knob. At this position, a shaft may be inserted or retracted. When the pressure is released from the button, the spring fingers return the collar to its normal position and the small diameter portion of the aperture engages a narrow portion formed on the shaft to prevent axial movement relative to the collar and the knob.

DETAILED DESCRIPTION OF THE INVENTION AND PREFERRED EMBODIMENT THEREOF

The present invention provides an integral collar adapted to be easily assembled into a component, such as for example, a knob so as to securely hold the component onto a specially formed shaft and to be able to readily release the shaft when required. The shaft retaining collar is preferably formed of plastic by the process of molding, but could be made of other materials or by other methods.

Figure 1:
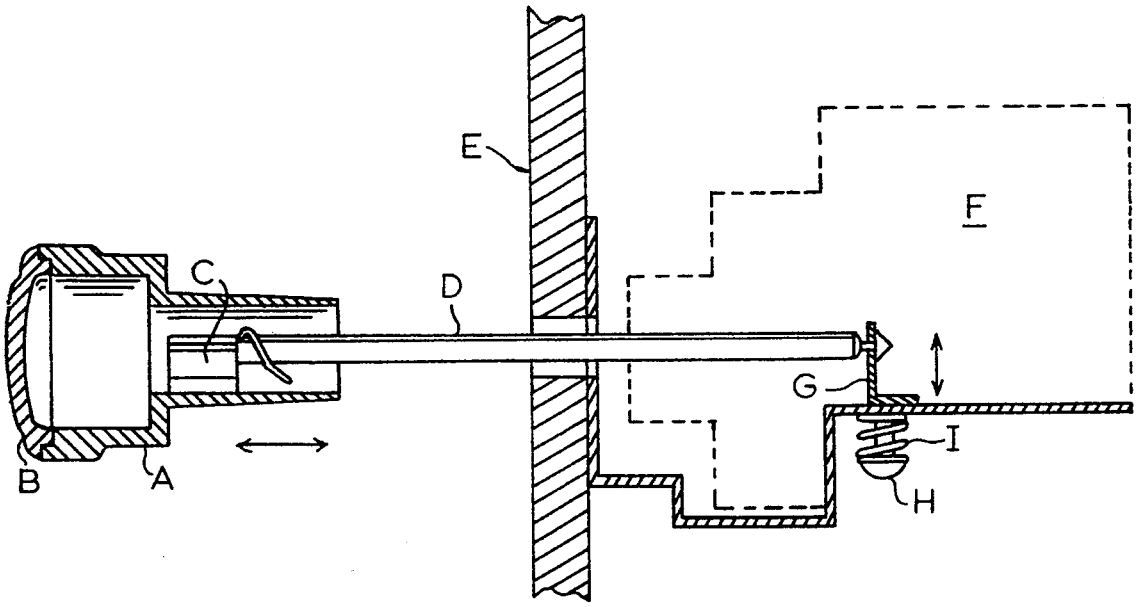
PRIOR ART FIG. 1
FIG. 1 is a diagrammatic section elevation view of a knob, shaft and retaining clip of the prior art as used with a typical automotive light switch.
Figure 2A:
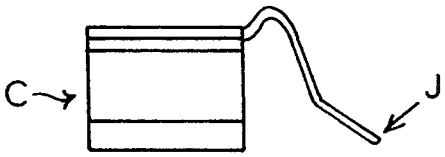
PRIOR ART FIG. 2A
FIG. 2A is a side elevation view of a metal clip of the prior art.
Figure 2B:
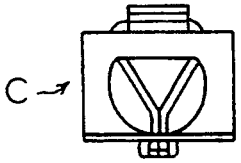
PRIOR ART FIG. 2B
FIG. 2B is an end elevation view of the metal clip of FIG. 2A.
Figure 3:
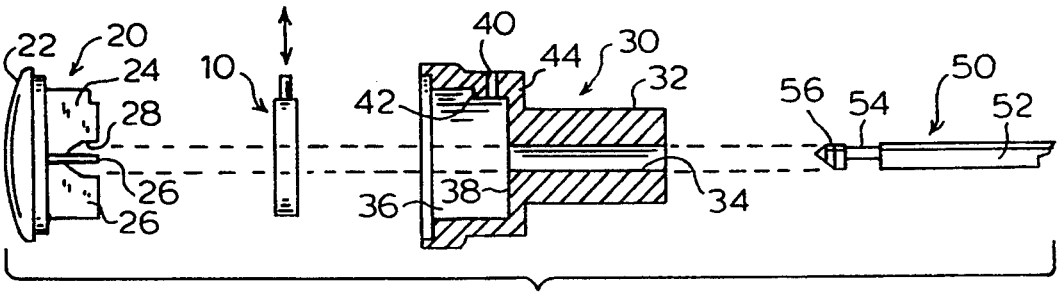
FIG. 3 is an exploded sectional side elevation view of the shaft retaining collar of the invention in position to be assembled into a typical knob and then mounted onto an appropriately formed shaft.

An exemplary apparatus of the prior art for retaining a shaft against relative axial movement is illustrated in FIGS. 1, 2A and 2B and is found, for example, used in a Ford Motorcraft Model No. E77B-11654-AA Switch. In FIG. 1, a section view of a complete assembly in a vehicle is shown mounted on dashboard facia E. On the passenger compartment side of dashboard facia E is knob body A into which metal clip C is pressed and to which knob cap B is affixed. Shaft D is securely held by metal clip C so that shaft D cannot move axially relative to the knob A. Switch F is mounted on the firewall side of dashboard facia E in position to accept the opposite end of shaft D, which end is machined with a circumferential groove near the extremity. The tip of shaft D passes through "L" shaped clip G which has a keyhole shaped opening and is mounted adjacent a button H with a spring I. When button H is pressed, spring I yields and clip G is raised to permit shaft D to be inserted or removed.

Additional detail of metal clip C is shown in side elevation in FIG. 2A and in end elevation in FIG. 2B. The formation of clip C is such that it holds shaft D (FIG. 1) securely against axial movement and will not release shaft D except if clip C is compressed by a tool as indicated by tool J. When assembled as shown in FIG. 1, it is difficult to insert tool J to release shaft D, and frequently the knob is merely forced off shaft D, damaging clip C in the process.

Figure 4:
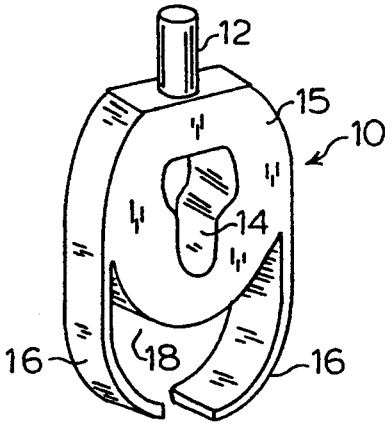
FIG. 4 is a perspective view of the shaft retaining collar of the invention.

FIGS. 3–7 illustrate the shaft retaining collar of the invention and various aspects of the knob and shaft to which it relates. FIG. 4 illustrates the shaft retaining collar 10 of the invention in perspective. Collar 10 is molded preferably of a plastic resin having a degree of resiliency and toughness, for example polycarbonate. Collar 10 has a button 12 integrally formed at the upper portion of base 15 and a pair of mirror image arcuate spring fingers 16 at the lower portion thereof encompassing an open area 18. In the central portion of collar 10 is a transverse keyhole shaped aperture 14 having an upper portion with a large diameter and a lower portion with a small diameter as per the illustrations. Aperture 14 is formed such that its axis resides substantially perpendicular to the axis of the button 12.

Figure 5:
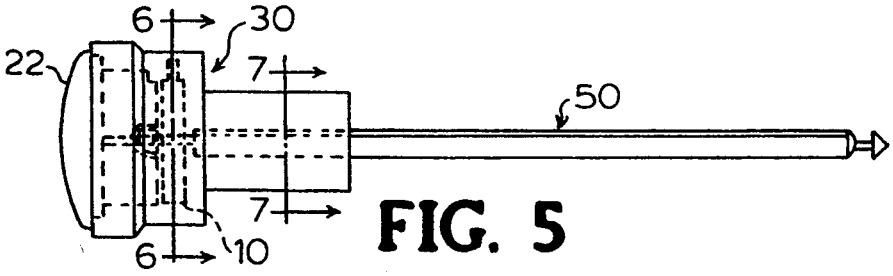
FIG. 5 is a side section view of the components illustrated in FIG. 3 as assembled.

Returning to FIG. 3, collar 10 is shown in position to be mounted in the total assembly which is illustrated exploded for clarity. The assembled unit is illustrated in FIG. 5 with all components in operative position. Collar 10 is first placed into knob cavity 36 with button 12 inserted through button hole 40. Collar 10 contacts rear cavity wall 38 (FIG. 3) and spring fingers 16 press against the bottom of cavity 36 to bias collar 10 upward to contact shoulder 42. Knob cap 20 is next placed into the opening of cavity 36 and is oriented with notched blade 24 against shoulder 42 and the three full blades 26 at fight angles thereto. Shaft nest 28 is configured at the intersection of blades 24, 26 and adapted to accept the tip 56 of shaft 50 when assembled thereto. It is understood that collar 10 is held in general alignment by the internal structure of knob body 30 and cap 20, with sufficient freedom for collar 10 to be moved linearly by application of a minimum of force.

Figure 7:
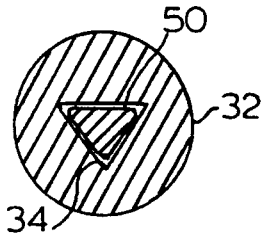
FIG. 7 is a section view taken in the direction of line 7—7 of FIG. 5.

Knob head 44 is integrally formed with knob body 32, which has knob aperture 34 formed with a triangular cross sectional configuration to accommodate a triangular cross section shaped shaft 50. The cross section of aperture 34 is shown in FIG. 7 with shaft 50 in place. The non-round shapes of shaft 50 and aperture 34 prevent relative rotation therebetween. Other non-round shapes are acceptable, though a triangular cross section is preferred.

Returning to FIG. 3, shaft 50 is formed with a circumferential groove 54 separating shaft body 52 from tapered shaft tip 56. As will be described further, the groove 54, when engaged by collar 10 within knob body 30 prevents relative axial movement of the shaft 50 therebetween.

Figure 6A:
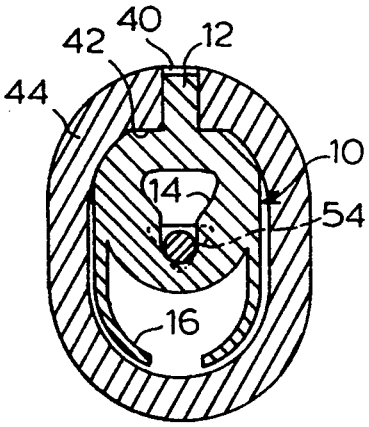
FIG. 6A is a section view taken in the direction of line 6—6 of FIG. 5 and showing the shaft retaining collar in its normal operating position so that a shaft (partially shown in dashed lines) is retained thereby.
Figure 6B:
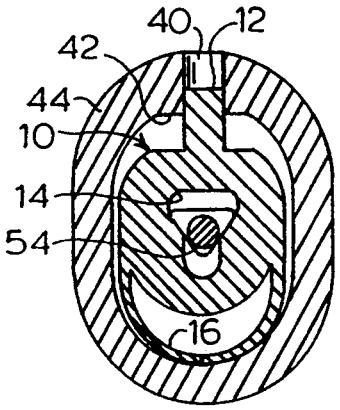
FIG. 6B is a section view like FIG. 6A but with the shaft retaining collar pressed downward to flex the spring fingers thereof and allow the shaft to be removed.

The insertion or removal of shaft 50 in knob body 30 is next described in reference to FIGS. 6A and 6B. FIG. 6A shows collar 10 assembled within knob head 44 with resilient fingers 16 extended and button 12 completely within button hole 40. In this situation, the smaller diameter portion of collar aperture 14 is aligned with the center of knob aperture 34 and shaft 50 cannot axially move. However, when button 12 is pressed into knob head 44, as in FIG. 6B, spring fingers 16 are compressed and collar 10 moves downward to a position where spring fingers 16 contact one another and the larger diameter portion of keyhole aperture 14 is aligned with the center of shaft 50. In this position, shaft 50 may be moved into or out of knob 30 thus enabling the knob to be easily removed from the shaft.

It is to be noted that knob head 44 is formed in an elliptical shape with parallel internal sides serving as straight guide surfaces for the linear movement of collar 10 whose side surfaces are complementarily shaped. The rounded shape of the lower portion of cavity 36 assists in flexing spring fingers 16 and guiding them to the point of mutual contact. Further, the length of button 12 is sufficient to permit pressing collar 10 into releasing alignment with shaft 50 without permitting button 12 to escape from button hole 40. Similarly, the length and curvature of spring fingers 16 are adapted to stop the downward movement of collar 10 by virtue of the two spring fingers 16 coming into contact with each other and are also adapted to permit collar 10 to achieve the correct position to receive or release shaft 50 from aperture 14.

The present invention has thus provided a button actuated shaft retaining collar in a switch knob such that a simple tool, such as a pencil point, used on the passenger side of the dashboard facia of a vehicle when applied to button 12 will enable the removal of the knob, and thereafter the facia. In addition, the integral forming of spring fingers of a selected length and curvature creates a resilient action to the collar of the invention with an automatic stop at the correct height, all without secondary parts assembly.

It is further recognized that an additional application of the collar of the invention would be to use the collar to anchor one end of the light switch knob shaft which is inserted into the light switch.

While the invention has been described with reference to specific embodiments thereof, it will be appreciated that numerous variations, modifications, and embodiments, including material and forming method, are possible, and accordingly, all such variations, modifications, and embodiments are to be regarded as being within the spirit and scope of the invention.

What is claimed is:

1. A knob adapted to be mounted onto a shaft having an intermediate portion with a reduced cross-section so as to prevent axial and rotational movement relative to said shaft when so mounted, comprising:

(a) a knob body having a shank with an axial aperture formed therethrough and a head having an internal axial cavity of a selected shape surrounded by a wall and with a radially extending hole formed from said cavity outwardly through the wall of said head;

(b) said shank aperture formed of a cross sectional shape adapted to receive said shaft in non-rotatable engagement;

(c) a knob cap configured to assemble into an open end of said cavity;

(d) a shaft retaining collar configured to nest slidably in said cavity in perpendicular relation to the axial direction of said knob, said collar comprising:

(i) a base portion with two opposed substantially planar faces and having an aperture with a relatively large portion and a relatively small portion extending transversely therethrough in perpendicular relation to said faces;

(ii) button means extending outwardly from said base portion in a direction perpendicular to the axis of said aperture and adapted to slidingly fit into said hole in the wall of said head;

(iii) biasing means integral with and in flexible relation with said base portion and adapted to maintain said small portion of said aperture axially aligned with said reduced cross-section portion of said shaft so as to retain said shaft against relative axial movement and when pressure is applied to said button means moving said collar to a position so that said relatively large portion of said aperture aligns with said shaft to allow said shaft to move axially; and (iv) said biasing means comprising a pair of resilient spring fingers each connected to said base portion at respective opposed lateral portions thereof and configured with a curvature and length so as to contact an interior surface of said cavity and to move towards one another when said collar is depressed within said cavity to a point that said larger portion of said aperture is axially aligned with said shaft.

2. The knob of claim 1 wherein said internal cavity in said knob head is formed to create means to guide said shaft retaining collar in a substantially straight line when said button means is depressed.

3. The knob of claim 2 in which the button means on said shaft retaining collar is formed of a length so that said button means, when fully depressed, remains within said hole in said head wall.

4. A shaft retaining collar configured to nest within a cavity of a component and adapted to receive and hold a shaft having an intermediate portion with a reduced cross-section so as to restrain said shaft against axial movement relative to said component, said collar comprising:

(a) a base portion having two opposed substantially planar faces with an aperture extending transversely from one to another of and in perpendicular relation to said faces;

(b) button means integral and in rigid .relation with said base portion and protruding upwardly therefrom in a direction perpendicular to the axis of said aperture;

(c) biasing means integral and in flexible relation with said base portion and protruding downwardly therefrom and adapted to maintain said collar aperture in a position so as to engage said reduced cross-section portion of said shaft and retain said shaft against relative axial movement, and when pressure is applied to said button means to allow said aperture to move into a position so as to release said shaft; and (d) said biasing means comprising a pair of resilient spring fingers each connected to said base portion at respective opposed lateral portions thereof and configured with a curvature and length adapted to contact opposed laterally spaced interior surfaces of said cavity and to move towards one another when said collar is depressed within said cavity by pressure on said button means to a position so as to release said shaft and to move away from one another when said collar is released from said pressure.

* * * * *